United States Patent [19]

Gore et al.

[11] Patent Number: 4,669,243

[45] Date of Patent: Jun. 2, 1987

[54] FIRE PROTECTIVE SYSTEM AND METHOD FOR A SUPPORT STRUCTURE

[75] Inventors: Charles E. Gore, Colleyville; Joseph W. Vierthaler, Jr., Bedford, both of Tex.

[73] Assignee: Truswal Systems Corporation, Irving, Tex.

[21] Appl. No.: 795,361

[22] Filed: Nov. 6, 1985

[51] Int. Cl.[4] ..... E04C 3/02

[52] U.S. Cl. ..... 52/696; 52/694; 52/376

[58] Field of Search ..... 52/693, 694, 696, 376, 52/373, 692, 642

[56] References Cited

U.S. PATENT DOCUMENTS

| | | | |
|---|---|---|---|
| 2,007,898 | 7/1935 | Ragsdale | 52/692 |
| 2,129,625 | 9/1938 | Rafter | 52/376 |
| 2,167,835 | 8/1939 | Greulich | 52/376 |
| 2,167,836 | 8/1939 | Greulich | 52/376 |
| 2,387,432 | 10/1945 | Du Laney | 52/376 |
| 2,996,160 | 8/1961 | Voight | 52/376 |
| 3,517,474 | 6/1970 | Lanternier | 52/729 X |
| 3,913,290 | 10/1975 | Billing et al. | 52/729 X |
| 3,950,912 | 4/1976 | Lundberg et al. | 52/727 |
| 4,413,459 | 11/1983 | Lambuth | 52/729 |
| 4,456,497 | 6/1984 | Eberle | 52/729 X |
| 4,485,606 | 12/1984 | Gottlieb | 52/696 X |

FOREIGN PATENT DOCUMENTS

| | | | |
|---|---|---|---|
| 27832 | 5/1981 | European Pat. Off. | 52/694 |
| 79761 | 5/1983 | European Pat. Off. | 52/729 |
| 2289694 | 5/1976 | France | 52/729 |
| 632809 | 11/1978 | U.S.S.R. | 52/694 |

*Primary Examiner*—William F. Pate, III
*Assistant Examiner*—Creighton Smith
*Attorney, Agent, or Firm*—W. Kirk McCord

[57] ABSTRACT

A fire protective system and method for a support structure such as a truss having top and bottom chord members, web members extending between the top and bottom chord members and connector plates for connecting the respective ends of the web members to the top and bottom chord members. Fire protection is provided by an elongated metal member having a base portion and a pair of flanges projecting upwardly from the base portion to form a channel. The bottom chord member is received within the channel so that the flanges extend at least partially upwardly along respective opposite sides of the bottom chord member and are in contact therewith. The web members are preferably comprised of V-shaped metal webs having a central toothed connector plate, a pair of elongated arms diverging outwardly from the central connector plate and a pair of toothed connector plates integrally formed on respective ends of the arms opposite the central connector plate.

25 Claims, 8 Drawing Figures

FIRE PROTECTIVE SYSTEM AND METHOD FOR A SUPPORT STRUCTURE

FIELD OF THE INVENTION

The present invention relates generally to building support structures and particularly to a system and method for protecting a support structure against fire.

BACKGROUND OF THE INVENTION

In the building industry there are many applications in which a load bearing member, such as a truss or beam, is required which is light in weight and has the ability to support large loads over long, clear spans. Trusses of various shapes and sizes are typically used to support the floor and roof of multi-story buildings, such as residential apartments and office buildings. A truss is typically comprised of a top chord and a bottom chord, which may be mutually parallel or inclined with respect to one another, depending upon the type of the truss. For example, in a flat truss, which is used to support a floor, the top and bottom chords are disposed in parallel relationship. In a cantilever or vaulted scissors truss, which is used to support the roof of a building, the top chord is inclined with respect to the bottom chord and is comprised of two chord members which intersect at the apex of the truss. The top and bottom chords are typically co-planar and are interconnected by means of metal or wooden webs, which extend diagonally between the top and bottom chords. Beams of various sizes and shapes are also used for structural support. A beam is typically comprised of top and bottom flanges interconnected by a web member, which may be a sheet of plywood or the like.

In order for a support structure to be commercially viable, it must achieve the required fire resistance rating for the particular support structure. Standard fire resistance tests are used to rate and compare load bearing structures, such as trusses and beams, which are used in the construction of buildings. The test measures the ability of a support structure to resist failure for a particular period of time when subjected to the standard fire exposure conditions prescribed by the test. Failure can occur either when flames, hot gasses or excessive heat escapes from the test assembly or when there is a structural collapse of the assembly. Unprotected wooden trusses and beams may not be able to achieve the required fire resistance ratings, thereby necessitating the application of fire protective materials to the support structures to enhance their fire resistance.

DESCRIPTION OF THE PRIOR ART

According to prior practice, the required fire resistance ratings for wooden support structures are achieved by one of the following methods: (1) suspending non-combustible grid panels below the support structure; (2) attaching resilient steel furring channels to the bottom member of the support structure and attaching a layer of gypsum wallboard to the channels; and (3) securing a double layer of gypsum wallboard to the bottom member of the support structure. The aforementioned three methods, as well as other prior art methods, substantially increase the cost of labor and materials associated with the installation of the support structure in a building because additional fire proofing materials must be used and such materials must be applied to the support structure at the site of the installation.

It is also known in the art to attach metal sheets to the surfaces of wooden partitions and ceilings for the purpose of protecting them from heat and to attach strips of metal to the individual chord members of a truss to enhance the structural integrity of the truss. However, it has not heretofore been known in the art to attach elongated metal members to the individual members of a truss or beam in order to achieve the necessary fire resistance.

OBJECTS OF THE INVENTION

It is therefore the principal object of the present invention to provide an improved fire protective system and method for a support structure.

It is another object of the present invention to provide a system and method for rendering a support structure substantially fire resistant, which is more cost effective and less time consuming to implement than conventional fire protective systems and methods.

It is yet another object of the present invention to provide a support structure which is rendered substantially fire resistant during the process of manufacturing the support structure, thereby eliminating the need for fire-proofing the support structure at the site of installation thereof.

It is a further object of the present invention to provide a support structure which is substantially resistant to structural collapse in the event of a fire.

It is still a further object of the present invention to provide a fire protective system and method for a support structure which enables the support structure to meet the required fire resistance rating, while effecting substantial savings in the cost of and time required for assembly and on-site installation of the support structure.

SUMMARY OF THE INVENTION

These and other objects are accomplished in accordance with the present invention wherein a support structure is comprised of top and bottom members; an elongated metal member having a base portion and a pair of oppositely positioned, depending side walls which cooperate with the base portion to form an enclosure. The metal member is disposed on the bottom member so that at least a portion of the bottom member is contained within the enclosure for protecting the support structure against fire. The support structure further includes means interconnecting the top and bottom members to form the support structure. The interconnecting means includes means connecting a first end of the interconnecting means to the top member and means connecting a second end of the interconnecting means to the metal member and to the bottom member, thereby enhancing the structural integrity and fire resistance of the support structure.

In one aspect of the invention the support structure is a truss having top and bottom chord members. In one embodiment the interconnecting means is comprised of a plurality of web members extending between the top and bottom chord members. Each of the web members has connector plates disposed on respective opposite ends of the web member for attaching the web member to the top and bottom chord members. In another embodiment the metal member has a pair of flanges projecting upwardly from the base portion to form a channel. The bottom chord member is received within the channel so that the flanges extend at least partially upwardly along respective opposite sides of the bottom chord member. The flanges may have a spring characteristic which biases them inwardly against the respective sides of the bottom chord member to provide a friction fit therebetween, or, alternatively, the flanges may be stapled to the sides of the bottom chord member.

In the preferred embodiment the top and bottom chord members are comprised of a wood material and each of the web members is comprised of a first connector plate, a pair of elongated arms diverging outwardly from the first connector plate and second and third connector plates disposed at respective ends of the arms opposite from the first connector plate. The connector plates and arms are integrally formed from a metal material to provide a V-shaped web member. Each of the connector plates has integral teeth projecting outwardly therefrom for being embedded into the top and bottom chord member. The first connector plate is positioned in contact with the corresponding flange so that at least a portion of the teeth penetrate through the flange and into the bottom chord member, thereby effecting a positive connection of the first connector plate and the flange to the bottom chord member.

The preferred method of assembling the truss structure of the present invention is by placing a first plurality of web members on a support device having first and second support members so that the first connector plate of each web member is resting on the first support member and the second and third connector plates are resting on the second support member with the respective teeth projecting upwardly. The first and second support members are spaced apart in accordance with the desired spacing between the top and bottom chord members. The bottom chord member is then positioned above the respective first connector plates so that a first side of the bottom chord member faces downward and is in contact with the respective teeth of the first connector plates. The top chord member is positioned above the second and third connector plates so that a first side of the top chord member faces downward and is in contact with the respective teeth of the second and third connector plates.

A second plurality of web members is positioned on the support device so that the teeth of the first connector plates project downwardly and are in contact with a second, upwardly facing side of the bottom chord member and the teeth of the second and third connector plates face downwardly and are in contact with a second, upwardly facing side of the top chord member. Sufficient pressure is then applied normal to the connector plates of the second plurality of web members to sandwich the top and the bottom chords between the first and second plurality of web members and cause the teeth of the second and third connector plates to be embedded into the top chord member and the teeth of the first connector plates to penetrate through the flanges of the metal member and be embedded in the bottom chord member.

In another aspect of the invention the support structure is comprised of a beam having top and bottom flange members; an elongated metal member having a base portion and a pair of oppositely positioned, depending side walls which cooperate with the base portion to form an enclosure, in which at least a portion of the bottom flange member is received; and means interconnecting the top and bottom flange members to form the beam structure. The interconnecting means includes means connecting a first end thereof to the top flange member and a second end thereof to the bottom flange member and the metal member, thereby enhancing the structural integrity and fire resistance of the beam structure.

In a preferred embodiment the top and bottom flanges have respective first and second parallel facing surfaces with respective first and second elongated grooves disposed thereon. The interconnecting means is comprised of an elongated sheet member disposed between the top and bottom flanges, having first and second oppositely positioned edges extending longitudinally along the sheet member. The first and second edges are received within the respective first and second grooves to interconnect the top and bottom flange members.

The metal member is preferably comprised of a sleeve for enveloping the bottom flange. The sleeve has a top portion, bottom portion and oppositely positioned side walls connecting the top and bottom portions. The top portion has an elongated opening in registration with the second groove to allow access to the groove so that the sheet member extends through the opening when the second edge of the sheet member is received within the groove. The metal member further includes first and second extension portions projecting downwardly from the top portion and communicating with the groove. The sheet member is positively connected to the bottom flange member and to the metal member by means of an adhesive material or other suitable connecting means to enhance the structural strength and rigidity of the beam structure.

The metal member provides substantial protection for the support structure against fire and acts as a heat sink and/or reflector and as a means for deflecting flames from the wooden members of the support structure. The positive contact among the connector members, metal member and bottom member of the suppoort structure enchances the structural integrity thereof and renders the support structure more resistant to structural collapse in the event of a fire. The application of the metal guard member to the bottom chord member during the same step of the truss assembly process at which the web members are attached to the top and bottom chord members effects substantial cost savings in the assembly and installation of the truss by providing a prefabricated, fire resistant truss.

BRIEF DESCRIPTION OF THE DRAWINGS

Still further objects and advantages of the invention will be apparent from the Detailed Description and Claims when read in conjunction with the accompanying drawings wherein:

DETAILED DESCRIPTION OF THE PREFERRED EMBODIMENT

In the description which follows, like parts are marked throughout the Specification and Drawings, respectively. The drawings are not necessarily to scale and in some instances proportions may have been exaggerated in order to more clearly depict certain features of the invention.

Figure 1:
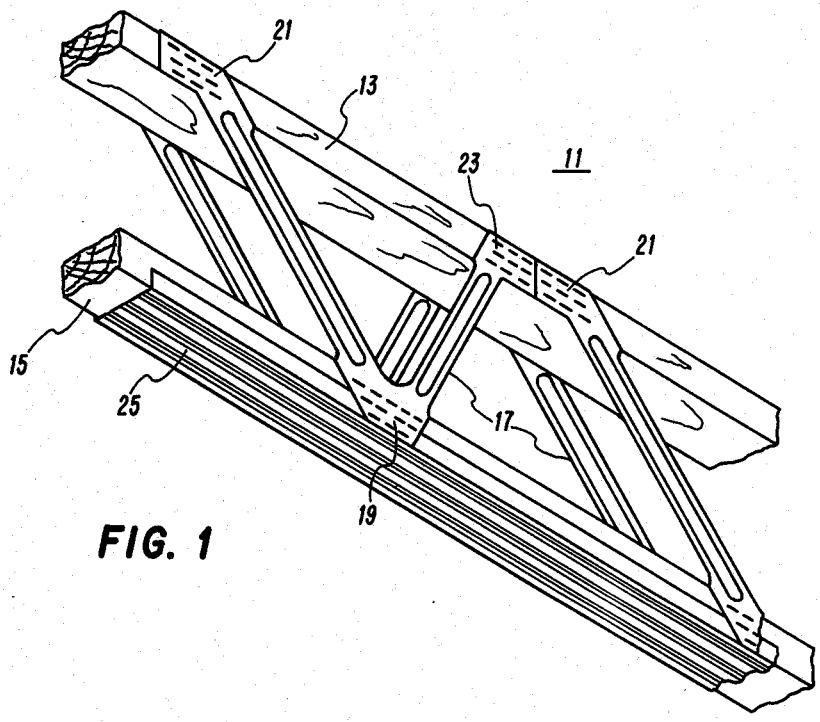
FIG. 1 is a perspective view of a truss structure according to the present invention.

Referring now to FIG. 1, a truss structure 11 according to the present invention is comprised of top and bottom chord members 13 and 15, respectively, which are interconnected by means of a plurality of V-shaped web members 17. Each web member 17 is comprised of a pair of elongated arms which diverge outwardly from a central connector plate 19 and terminate at respective connector plates 21 and 23 at respective ends of the arms opposite connector plate 19. Disposed on the lower surface of the bottom chord member 15 is an elongated metal member 25, which functions as a fire guard for truss 11.

Figure 2A:
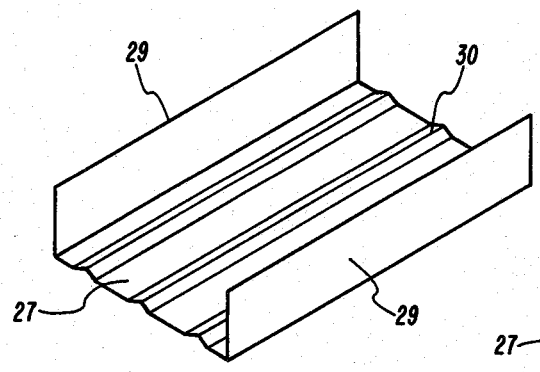
FIG. 2A is a perspective view of an elongated metal guard member for being applied to the bottom chord of the truss to provide fire protection therefor.
Figure 2B:
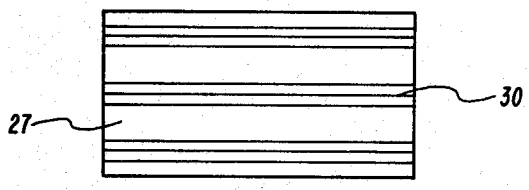
FIG. 2B is a bottom plan view of the metal guard member shown in FIG. 2A.

Referring also to FIGS. 2A and 2B, metal member 25 is comprised of a base portion 27 and a pair of flanges 29 projecting upwardly from the base portion 27 to form a substantially U-shaped channel. Base portion 27 has lines of corrugation 30 along the major axis thereof, as shown in FIG. 2B, to increase the rigidity of metal member 25 along the major axis thereof and to provide an air space 32 between base portion 27 and lower surface 33 of bottom chord member 15, as best seen in FIG. 3B. Air space 32 further enhances the fire resistance of truss structure 11. Metal member 25 is preferably comprised of a steel material having the characteristics of ductility and roll formability, with a thickness preferably in the range between 0.004 inch to 0.020 inch, although greater thicknesses may be effectively used. It has been found that steel having a thickness in the aforementioned range of 0.004 inch to 0.020 inch provides the desired structural strength and fire protection, while allowing tooth penetration by a connector plate to be easily accomplished.

Figure 3A:
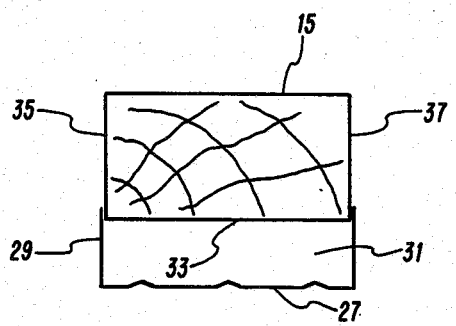
FIGS. 3A and 3B are end elevation views showing the application of the metal guard member to the bottom chord of the truss.
Figure 3B:
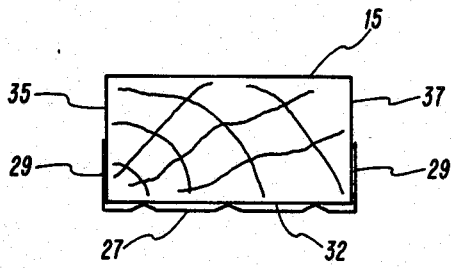

Referring to FIGS. 3A and 3B, metal member 25 is applied to bottom chord member 15 by sliding it lengthwise along bottom chord member 15 so that metal member 25 in effect forms a half-sleeve for partially enveloping bottom chord member 15 within channel 31. As shown in FIG. 3B, when metal member 25 is properly positioned on bottom chord member 15, base portion 27 is partially in abutment with lower surface 33 of bottom chord member 15 along corrugation lines 30 and flanges 29 extend partially upwardly along opposite side surfaces 35 and 37 and are in contact therewith. Flanges 29 may be stapled to respective side surfaces 35 and 37, or, alternatively, the metal material comprising flanges 29 may have a spring bias to hold flanges 29 against respective side surfaces 35 and 37 to provide a friction fit between bottom chord member 15 and metal member 25.

Top chord member 13 and bottom chord member 15 may be comprised of standard construction members, such as wooden two by fours. When metal member 25 is applied to bottom chord member 15, as described above, flanges 29 extend at least a ½ inch upwardly along the 1 and ½ inch height of side surfaces 35 and 37 to allow a sufficient area for connector plate 19 to penetrate metal member 25 and provide a positive contact between metal member 25 and bottom chord member 15, as will be described in greater detail with reference to FIGS. 4 and 5. In another embodiment the fire resistance of truss 11 may be further enchanced by applying a second metal member 25 to the corresponding lower surface of top chord member 13 in substantially the same manner as described below with reference to bottom chord member 15.

Figure 4A:
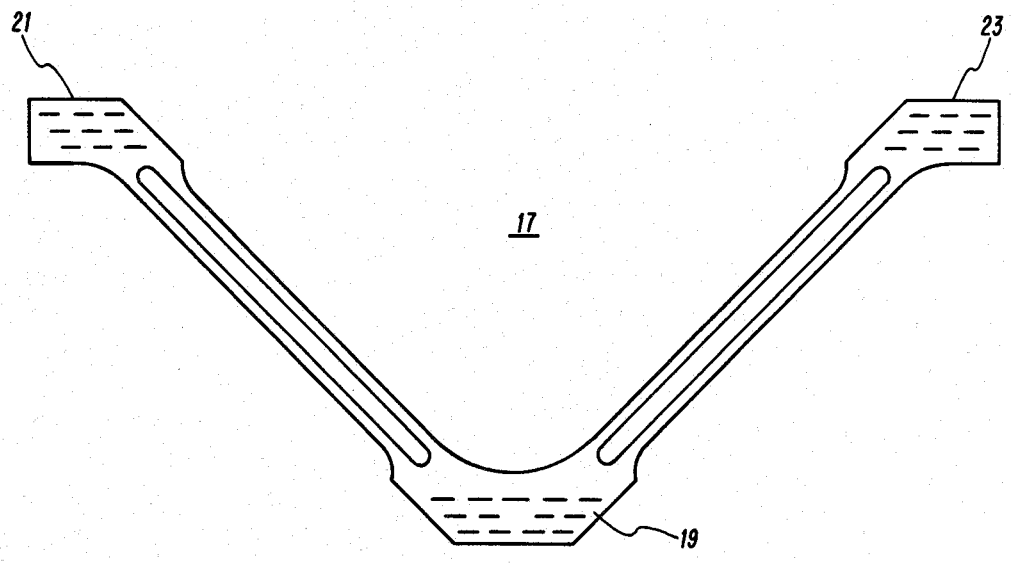
FIG. 4A is a side elevation view of a metal web member used to connect the top and bottom chords of the truss.
Figure 4B:
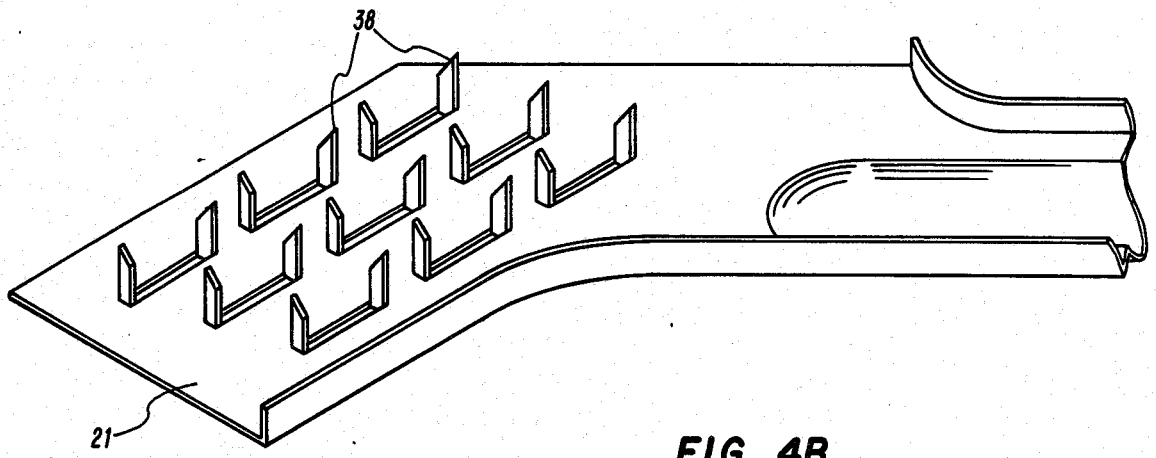
FIG. 4B is a perspective view of a connector plate and integral teeth formed thereon for attaching the web member to the top and bottom chords of the truss.

Referring to FIGS. 4A and 4B, web member 17 is comprised of a V-shaped metal member in which the diverging arms and connector plates 19, 21 and 23 are integrally formed as a unit. Connector plates 19, 21 and 23 have disposed on respective sides thereof a plurality of teeth 38 projecting outwardly from the respective sides of the connector plates. Web members 17 are preferably of the type described and claimed in U.S. Pat. No. Re. 31,807. Such web members are manufactured and sold by Truswal Systems Corporation of Irving, Tex. In an alternate embodiment conventional wooden web members may be used to interconnect top chord member 13 and bottom chord member 15. The wooden web members are attached to the top and bottom chords at respective opposite ends of the web members by means of conventional toothed connector plates or other conventional connecting devices.

Figure 5:
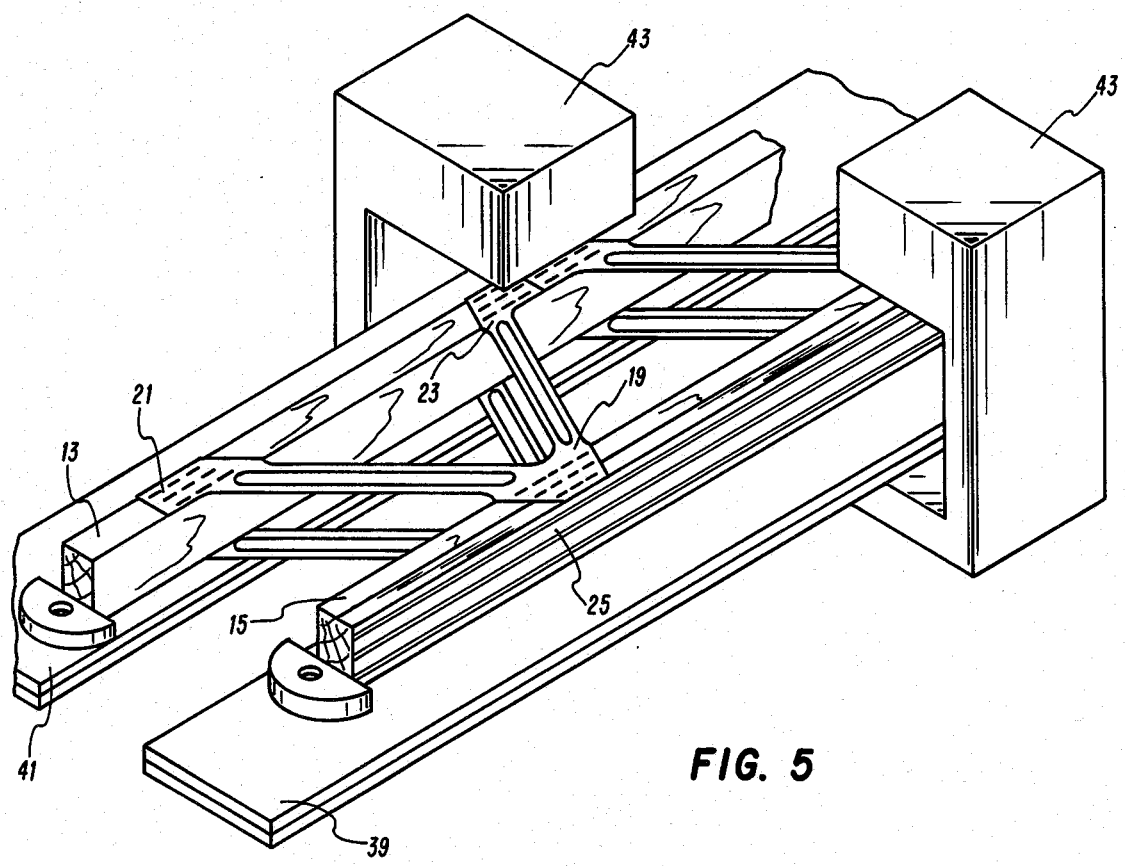
FIG. 5 is a perspective view showing the attachment of a metal web member to the metal guard and to the top and bottom chords of the truss.

Referring to FIG. 5, web members 17 are preferably attached to top chord member 13 and bottom chord member 15 using a truss assembly device similar to the type described and claimed in U.S. Pat. No. 4,002,116. Suitable assembly devices are sold by Truswal Systems Corporation of Irving, Tex. A portion of the truss assembly device is depicted in FIG. 5. First and second support members 39 and 41 are positioned on a floor or other relatively flat surface and are spaced apart to match the desired spacing between top and bottom chord members 13 and 15. A first set of metal web members 17 is positioned so that the respective connector plates 19 are resting on support member 39 and the respective connector plates 21 and 23 are resting on support member 41 with the respective teeth 38 projecting upwardly. Metal member 25 is applied to bottom chord member 15 before it is positioned in the truss assembly device. Top and bottom chord members 13 and 15 are positioned on top of respective support members 41 and 39 so that the respective side surfaces 35 of top and bottom chord members 13 and 15 are in contact with teeth 38 projecting upwardly from respective connector plates 19, 21 and 23 of the first set of web members 17.

After top and bottom chord members 13 and 15 are properly positioned, a second set of metal web members 17 is then placed above top and bottom chord members 13 and 15 so that the respective teeth 38 of connector plates 19, 21 and 23 of the second set of web members 17 are in contact with the respective side surfaces 37 of top and bottom chord members 13 and 15. Connector plates 19 are located so that substantial portions thereof are in contact with metal member 25 and connector plates 21 and 23 are positioned so that they butt up against corresponding connector plates 23 and 21 of adjacent web members 17 on either side, as best seen in FIG. 1.

An hydraulically operated press 43 is positioned directly above each of the chord members 13 and 15 for driving teeth 38 into the respective chord members. Teeth 38 of connector plate 19 penetrate completely through flanges 29 to provide a positive contact between connector plate 19 and corresponding flange 29 on each side surface 35 and 37 of bottom chord 15.

The foregoing procedure allows a fire protective material, namely metal member 25, to be installed at the manufacturing site, rather than at the site of installation of the truss. Thus, a prefabricated, substantially fire resistant truss can be delivered to the installation site and quickly installed without the necessity of installing fire protective materials on site. This not only saves time at the installation site, but also reduces the cost of the construction because it is substantially cheaper to install the fire protective materials during the manufacturing process rather than at the installation site. An additional cost savings is achieved by the fact that metal member 25 is attached to the truss during the same step in the assembly process at which the web members are attached to the chord members.

For example, it is anticipated that the labor costs to apply metal member 25 during the assembly of truss structure 11 is approximately $0.05 per square foot, whereas the labor cost to hang resilient furring channels from the truss at the installation site is on the order of $0.14 per square foot. Additional cost savings are achieved in materials because metal member 25 is substantially cheaper than the furring channels and attachment screws.

Figure 6:
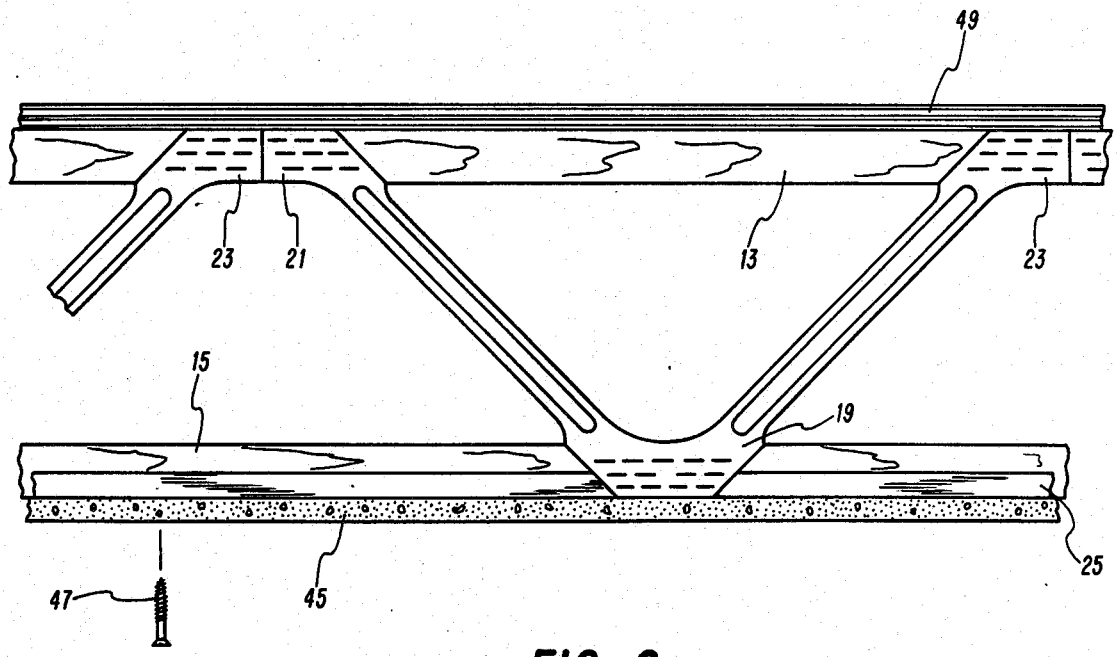
FIG. 6 is a side elevation view of a floor/ceiling truss assembly according to the present invention.

The truss structure according to the present invention has been tested in accordance with ASTM Standard E-119-83 to determine the fire resistance rating thereof. A floor/ceiling test assembly was constructed substantially as shown in FIG. 6. A $\frac{5}{8}$ inch thick gypsum wall board 45 is attached to bottom chord members 15 of the test assembly using $1\frac{5}{8}$ inch long dry wall screws 47, which penetrate through base portions 27 of metal members 25 and into the corresponding bottom chord members 15. A 23/32 inch thick sheet of plywood 49 is nailed to the respective top chord members 13 to form the top of the test assembly.

The test report indicated that failure occurred 62.5 minutes into the test which was 2.5 minutes longer than the time required to achieve the standard one hour fire resistance rating. Of particular significance is the fact that failure was due to an escape of hot gasses and smoke from the plywood floor and not from a structural failure of the truss, as had occurred in comparable test assemblies when resilient furring channels were used instead of metal members 25. Thus, the application of metal member 25 to bottom chord member 15 in lieu of the application of resilient furring channels resulted in a substantial improvement of the fire resistance rating of the truss structure, not only in terms of the endurance time (62.5 minutes for the truss structure equipped with the metal member versus 60 minutes for the truss structure equipped with the furring channels), but also in terms of maintaining the structural integrity of the truss to prevent collapse. It is therefore apparent that the fire protective system of the present invention is not only more economical than prior art systems, but also enhances the fire resistance of the truss.

An examination of the truss structure after the fire testing indicates that a positive connection is maintained among connector plates 19, metal member 25 and bottom chord member 15 such that metal member 25 effectively becomes a load carrying member of the truss to prevent the structural collapse thereof. It was also observed that screws 47 continued to provide a tight and stable connection between wall board and metal member 25, thereby resisting joint separation and subsequent sagging of wallboard 45. Some amount of sagging of wallboard 45 will nevertheless occur, which requires that metal member 25 be flexible enough to deflect with wallboard 45 as it sags, to maintain a stable connection therebetween, which is the key factor in resisting joint separation leading to fire and heat penetration through wallboard 45.

Figure 7:
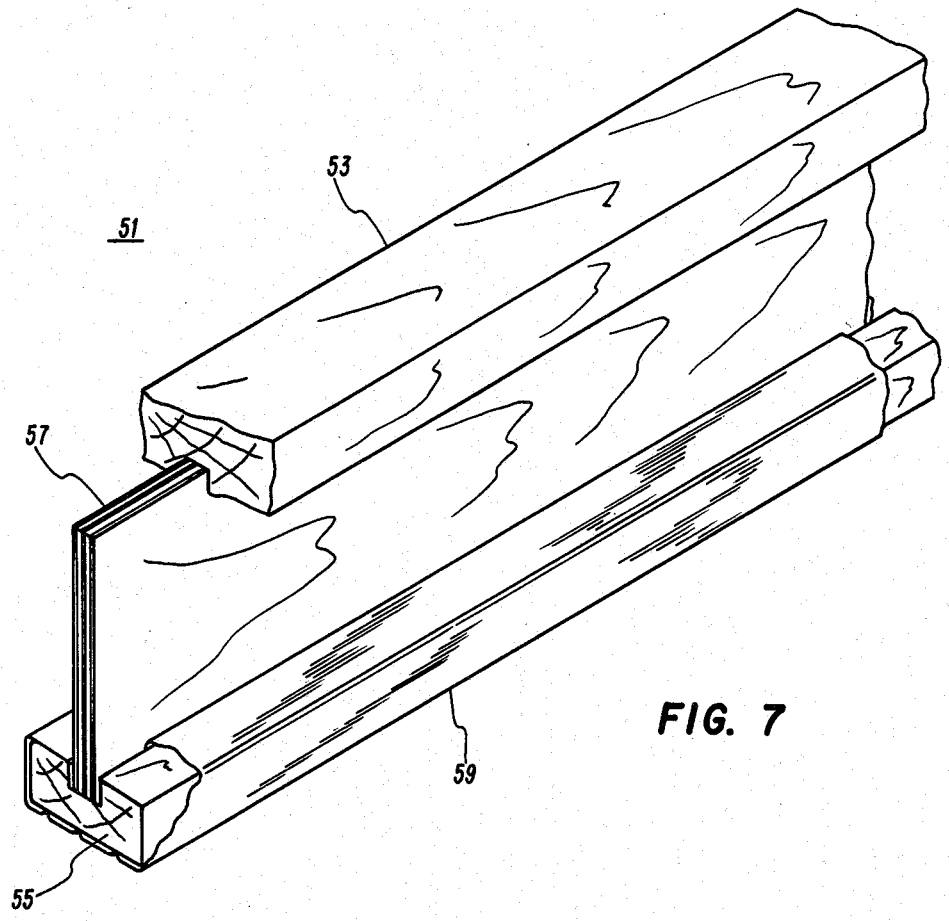
FIG. 7 is a perspective view of an alternate embodiment of a support structure according to the present invention, with portions of the structure cut away for illustration purposes.
Figure 8:
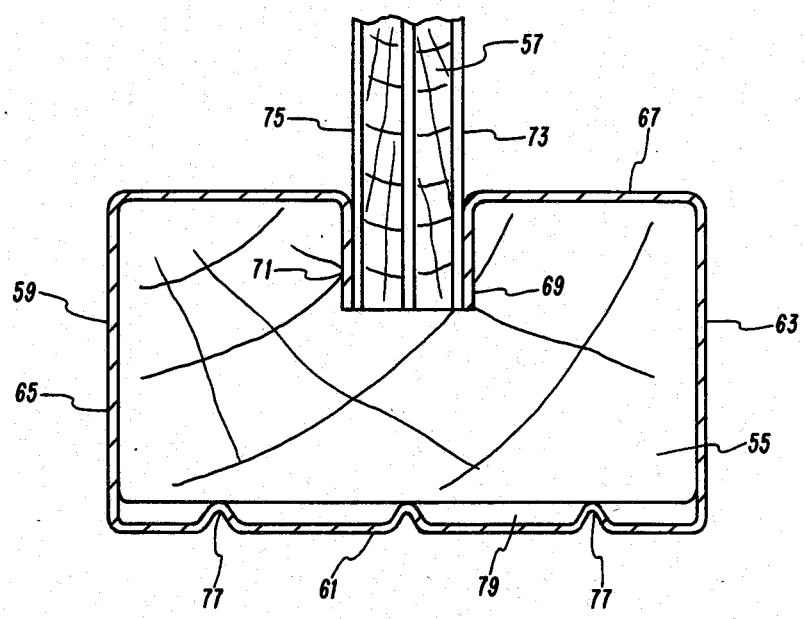
FIG. 8 is an end view of the lower portion of the support structure of FIG. 7.

Referring to FIGS. 7 and 8, an alternate embodiment of the present invention is depicted. A beam structure 51 is comprised of top and bottom flange members 53 and 55, respectively, and a web member 57 interconnecting top and bottom flange members 53 and 55. Web member 57 is preferably comprised of an elongated sheet of plywood or the like, the opposite edges of which are received within elongated grooves formed in the respective facing surfaces of top and bottom flange members 53 and 55 along the longitudinal axis of beam structure 51.

A metal guard member 59 is disposed on bottom flange member 55 for providing fire protection for beam structure 51 in much the same manner that metal guard member 25 provides fire protection for truss structure 11, as described above. Metal guard member 59 is comprised of a base portion 61, a pair of oppositely positioned, depending side walls 63 and 65 and a top portion 67. Top portion 67 has an elongated opening in the central portion thereof, which is substantially in registration with the elongated groove formed in bottom flange member 55 for allowing access to the groove through the opening in top portion 67. Disposed on opposite sides of the opening are a pair of extension portions 69 and 71, projecting downwardly from top portion 67 and being in contact with respective opposite interior facing surfaces of the groove. Glue or other appropriate adhesive material is disposed along the interior facing surfaces and the bottom of the groove and between extension portions 69 and 71 and the respective portions of side surfaces 73 and 75 of web member 57 which are received within the groove, for effecting a positive connection of web member 57 to bottom flange member 55 and metal guard member 59. Glue or other appropriate adhesive material is also used in much the same manner to connect web member 57 to top flange member 53.

Bottom portion 61 of metal guard member 59 preferably includes lines of corrugation 77 for stiffening metal member 59 and providing an air gap 79 between the lower surface of bottom flange member 55 and base portion 61, to enhance the fire resistance of beam structure 51. In an alternate embodiment a second metal guard member 59 may be disposed on top flange member 53 in substantially the same manner as illustrated with respect to bottom flange member 55, to further enhance the fire resistance of beam structure 51. Although not yet tested in accordance with standard fire resistance tests, it is anticipated that a beam structure according to the present invention, as described above, will achieve the required fire resistance ratings. One skilled in the art will recognize that the fire protective system and method of the present invention may be effectively used to enhance the fire resistance of many other types of support structures.

Various embodiments of the invention have now been described in detail. Since changes in and modifications to the above-described preferred embodiment may be made without departing from the nature, spirit and scope of the invention, the invention is not to be limited to said details, except as set forth in the appended claims.

What is claimed is:

1. A truss structure, comprising:

top and bottom chord members;

means interconnecting said top and bottom chord members to form the truss;

an elongated metal member having a base portion and a pair of flanges projecting upwardly from opposite sides of said base portion to form a channel, said bottom chord member being received within said channel so that said flanges extend at least partially upwardly along respective opposite sides of said bottom chord member and are in contact therewith for protecting said truss structure against fire;

said interconnecting means having a first set of attachment members coupled to the top chord member at predetermined locations on respective opposite sides thereof and a second set of attachment members coupled to the bottom chord member at predetermined locations on respective opposite sides thereof, at least a portion of each of said second set of attachment members being in contact with a corresponding one of said flanges and with the bottom chord member for providing a positive connection of the attachment members and the flanges to the bottom chord member, thereby enhancing the structural integrity and fire resistance of the truss structure.

2. The truss structure according to claim 1 wherein said top and bottom chord members are wooden chord members having a substantially rectangular shape and arranged in substantially parallel relationship with respect to one another.

3. The truss structure according to claim 1 wherein said interconnecting means is comprised of a plurality of web members extending between the top and bottom chord members, said web members having attachment members disposed on respective opposite ends of each of said web members for attaching the ends of the web members to the top and bottom chord members.

4. The truss structure according to claim 3 wherein said attachment members are comprised of toothed connector plates for being embedded into the top and bottom chord members.

5. The truss structure according to claim 3 wherein each of said web members is comprised of a first connector plate, a pair of elongated arms diverging outwardly from said first connector plate and second and third connector plates disposed at respective ends of the arms opposite from the first connector plate, said first connector plate, said arms and said second and third connector plates being integrally formed from a metal material to provide a V-shaped web member.

6. The truss structure according to claim 5 wherein said first, second and third connector plates have integral teeth projecting outwardly therefrom for being imbedded into the top and bottom chord members, said first connector plate being positioned in contact with the corresponding flange so that at least a portion of the teeth projecting outwardly from said first connector plate penetrate through said corresponding flange and into the bottom chord number to provide a positive connection of said first connector plates and said flanges with said bottom chord member, said second and third connector plates being positioned in contact with the top chord member so that the teeth projecting outwardly from said second and third connector plates are imbedded into the top chord member.

7. The truss structure according to claim 1 wherein the base portion of the metal member is substantially in abutment with a lower surface of the bottom chord member.

8. The truss structure according to claim 1 wherein the base portion of said metal member is in facing relationship with a lower surface of the bottom chord member and at least a portion of said base portion is spaced apart from said lower surface to provide a predetermined air gap therebetween.

9. The truss structure according to claim 8 wherein said metal member has lines of corrugation extending along respective major axes thereof to stiffen the metal member along its lengthwise dimension and provide predetermined air gaps between said lines of corrugation.

10. The truss structure according to claim 1 wherein said flanges have a spring characteristic which biases said flanges inwardly against the respective sides of the bottom chord member to provide a friction fit therebetween.

11. The truss structure according to claim 1 wherein said metal member is comprised of a steel material.

12. The truss structure according to claim 1 wherein the gauge of the metal material comprising said metal member is within the range of 0.004 to 0.020 inch.

13. The truss structure according to claim 1 wherein said truss structure has first and second elongated metal members, said bottom chord member being received within the channel of said first metal member so that the flanges of said first metal member extend at least partially upwardly along respective opposite sides of the bottom chord member, said top chord member being received within the channel of said second metal member so that the flanges of said second metal member extend at least partially upwardly along respective opposite sides of said top chord member and are in contact therewith.

14. A method of providing fire protection for a truss structure having upper and lower chord members and means interconnecting the chord members to form the truss, said method comprising the steps of:

providing an elongated metal member having a base portion and a pair of flanges projecting upwardly from opposite sides of said base portion to form a channel;

placing said bottom chord member within said channel so that said flanges extend at least partially upwardly along respective opposite sides of said bottom chord member to protect the bottom chord member against fire;

positioning respective end portions of said interconnecting means in abutting relationship with said top chord member on respective opposite sides thereof and positioning respective opposite end portions of said interconnecting means in abutting relationship with the flanges and the bottom chord member on respective opposite sides of said bottom chord member; and securing said respective end portions of said interconnecting means to the top chord member and securing said respective opposite end portions of said interconnecting means to said flange members and to said bottom chord member to provide a fixed positive connection of the respective opposite end portions of the interconnecting means and the flanges to the bottom chord member, thereby enhancing the structural integrity and fire resistance of the truss structure.

15. The method according to claim 14 wherein the interconnecting means is comprised of a plurality of web members, the end portions of said web members include a first set of metal connector plates having metal teeth projecting outwardly therefrom and the opposite end portions of said web members include a second set of metal connector plates having metal teeth projecting outwardly therefrom, said first and second sets of connector plates being secured to the respective top and bottom chord members by the following steps:

providing a device for supporting the top and bottom chord members along the respective lengths thereof, said support device including first and second support members which are spaced apart in accordance with the desired spacing between the top and bottom chord members;

placing a first plurality of web members on said support device so that the first set of connector plates is resting on the first support member and the second set of connector plates is resting on the second support member with the respective teeth projecting upwardly;

positioning the top chord member above the first set of connector plates so that a first side of the top chord member faces downward and is in contact with the respective teeth of the first connector plates;

positioning the bottom chord member above the second set of connector plates so that a first side of the bottom chord member faces downward and is in contact with the respective teeth of the second set of connector plates;

placing a second plurality of web members on said support device so that the teeth of the first connector plates project downwardly and are in contact with a second, upwardly facing side of the top chord member and the teeth of the second set of connector plates face downwardly and are in contact with a second, upwardly facing side of the bottom chord member; and applying sufficient force normal to the first and second sets of connector plates of the second plurality of web members to sandwich the top and bottom chord members between the first and second plurality of web members and cause the teeth of the first set of connector plates to be embedded into the top chord member on respective opposite sides thereof and the teeth of the second set of connector plates to penetrate through the flanges of the metal member and be embedded in the bottom chord member on respective opposite sides thereof, thereby providing a fixed positive connection of the second set of connector plates and flanges to the bottom chord member at substantially the same step in the truss assembly process.

16. The method according to claim 15 wherein each of said web members is comprised of one of the second set of connector plates, a pair of arm members diverging upwardly from the second connector plate and two of the first set of connector plates integrally formed on the respective ends of the arms opposite the first connector plate.

17. A truss structure, comprising:

top and bottom chord members;

means interconnecting the top and bottom chord members to form the truss;

an elongated metal member having a base portion and pair of flanges projecting upwardly from opposite sides of said base portion to form a channel, said bottom chord member being received within said channel so that said flanges extend at least partially upwardly along respective opposite sides of the bottom chord member and are in contact therewith for protecting the truss structure against fire;

said interconnecting means interconnecting the top and bottom chord members by:

positioning respective end portions of the interconnecting means in abutting relationship with the top chord member on respective opposite sides thereof and positioning respective opposite end portions of the interconnecting means in abutting relationship with the flanges of the metal member and with the bottom chord member on respective opposite sides of the bottom chord member; and securing said respective end portions of the interconnecting means to the top chord member and securing the respective opposite end portions of the interconnecting means to the flanges and to the bottom chord member to provide a fixed positive connection of the interconnecting means and the flanges to the bottom chord member, thereby enhancing the structural integrity and fire resistance of the truss structure.

18. In a truss structure having top and bottom wooden chord members, a plurality of web members extending between the top and bottom chord members and being coupled thereto at respective opposite ends thereof to form the truss structure, means for protecting said truss structure against fire, said protective means comprising an elongated metal member having a base portion and a pair of flanges projecting upwardly from opposite sides of the base portion to form a channel, the bottom chord member being received within the channel so that the flanges extend at least partially upwardly along respective opposite sides thereof and are in contact therewith, to protect the truss against fire and means connecting respective first ends of said web members to the top chord member at predetermined locations on respective opposite sides of the top chord member and means connecting respective second ends of the web members to the flanges and to the bottom chord member at predetermined locations on respective opposite sides of the bottom chord member, thereby providing a fixed positive connection among the web members, flanges and bottom chord member to enhance the resistance of the truss to structural collapse in the event of fire.

19. The truss structure according to claim 18 wherein said connecting means is comprised of a plurality of toothed connector plates for penetrating the top and bottom chord members, selected ones of said connector plates penetrating through the flanges and into the bottom chord member to effect the fixed positive connection therebetween.

20. A building support structure comprising:

top and bottom members;

an elongated metal member having a base portion and a pair of oppositely positioned, depending side walls which cooperate with the base portion to form an enclosure, said metal member being disposed on said bottom member so that said bottom member is at least partially contained within said enclosure for protecting the support structure against fire; and means interconnecting said top and bottom members to form the support structure, said interconnecting means including means connecting a first end of said interconnecting means to the top member and means connecting a second end of the interconnecting means to the metal member and to the bottom member to provide a fixed positive connection among said interconnecting means, said metal member and said bottom member, thereby enhancing the structural integrity and fire resistance of the support structure.

21. A beam structure, comprising:

top and bottom flange members;

an elongated metal member having a base portion and a pair of oppositely positioned, depending side walls which cooperate with the base portion to form an enclosure, at least a portion of the bottom flange member being received within said enclosure for protecting the beam structure against fire;

means interconnecting the top and bottom flange members to form the beam structure, said interconnecting means including means connecting a first end of said interconnecting means to the bottom flange member and to the metal member to provide a fixed positive connection among the interconnecting means, the bottom flange member and the metal member, thereby enhancing the structural integrity and fire resistance of the beam structure.

22. A beam structure according to claim 21 wherein said top and bottom flange members are elongated flanges having respective first and second parallel facing surfaces, said first and second facing surfaces having respective first and second elongated grooves disposed therein extending longitudinally along the respective top and bottom flange members, said first end of said interconnecting means being disposed within said first groove and said second end of said interconnecting means being disposed within said second groove to interconnect the top and bottom flange members.

23. The beam structure according to claim 22 wherein said interconnecting means is comprised of an elongated sheet member disposed between the top and bottom flanges, said sheet member having first and second oppositely positioned edges extending longitudinally along the sheet member, said first and second edges being received with the respective first and second grooves.

24. The beam structure according to claim 23 wherein said metal member is comprised of a metal sleeve for substantially enveloping the bottom flange member, said sleeve having a top portion, bottom portion and oppositely positioned side walls extending between the top and bottom portions, said top portion having an elongated opening in registration with said second groove to allow access to said second groove so that a portion of said sheet member extends through said opening when the second edge of said sheet member is received within said second groove.

25. The beam structure according to claim 24 wherein said metal member further includes first and second extension portions projecting downwardly from said top portion and communicating with said groove, said first and second extension portions being substantially in contact with the respective first and second interior facing surfaces of said second grooves and with the portion of said sheet member received within said second groove on respective opposite sides of said sheet member.

* * * * *